United States Patent [19]

Vachek

[11] Patent Number: 4,662,638

[45] Date of Patent: May 5, 1987

[54] PUZZLE CUBE

[75] Inventor: Markus Vachek, Munich, Fed. Rep. of Germany

[73] Assignee: International Concept & Management Aktiengesellschaft, Liechtenstein

[21] Appl. No.: 758,018

[22] Filed: Jul. 24, 1985

[30] Foreign Application Priority Data

Dec. 5, 1984 [DE] Fed. Rep. of Germany ... 8435632[U]

[51] Int. Cl.[4] ..... A63F 9/12

[52] U.S. Cl. ..... 273/160; 273/DIG. 24

[58] Field of Search ..... 273/160, DIG. 24

[56] References Cited

U.S. PATENT DOCUMENTS

| | | | |
|---|---|---|---|
| 2,306,939 | 12/1942 | Ferris | 273/DIG. 24 X |
| 3,065,970 | 11/1962 | Besley | 273/160 |
| 3,638,949 | 2/1972 | Thompson | 273/160 X |
| 4,153,254 | 5/1979 | Marc | 273/160 |

FOREIGN PATENT DOCUMENTS

| | | | |
|---|---|---|---|
| 52215 | 9/1936 | Denmark | 273/160 |
| 11293 | of 1910 | United Kingdom | 273/160 |

*Primary Examiner*—Anton O. Oechsle

*Attorney, Agent, or Firm*—Sughrue, Mion, Zinn, Macpeak, and Seas

[57] ABSTRACT

A puzzle cube consists of a plurality of components which in spatially interengaging manner fill out the volume of the cube and are one detachable from the other. The volume of the cube is subdivided into sixty-four equally large small cubes, wherein thirteen geometrically different components (1 to 13) are provided, each of which consists of several small cubes placed with their side surfaces flush one against the other and connected firmly one with the other. At least two small cubes are placed one against the other in each of three mutually perpendicular spatial directions in each of the components.

7 Claims, 4 Drawing Figures

PUZZLE CUBE

Figure 4:
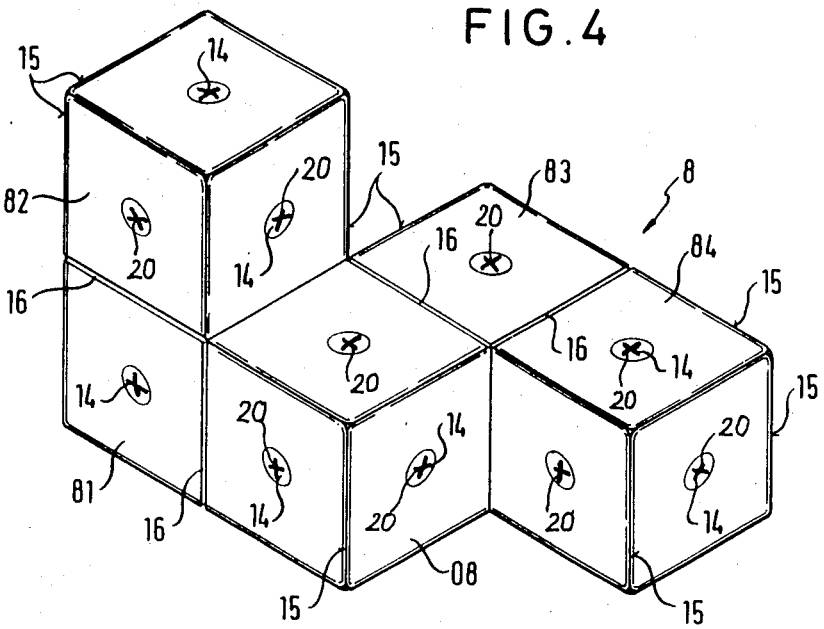

The invention concerns a puzzle cube consisting of a plurality of components which in spatially interengaging manner fill out the volume of the cube and are one detachable from the other.

For the purpose of the play and the entertainment, a plurality of cubes of that kind have already become known on the market. For example, a cube is known, which consists of a small number of wooden bricks which passing one through the other spatially are assemblable into a cube. Because of the small number of the components, this cube rapidly loses in play value and fascination, since it is assemblable without effort after the basic principle has once become known.

A further kind of these cubes has become known as Rubik's Cube ®. Although the components in this cube are basically detachable one from the other, they are however in use merely displaced one relative to the other in several planes in such a manner that the externally appearing surfaces of the components change their places at the different side surfaces of the total cube. It is possible in this manner to order the differently coloured external surfaces of the components according to colours or geometric patterns on the side surfaces of the entire cube. The displacement of the differently coloured external surfaces can in that case take place according to a mathematically formulatable principle which, once it has become known, lets the ordering of these surfaces become a routine activity. This cube thus in use addresses in the user merely the geometric sense of order on a surface spatial capability of imagination in respect of the structure and orientation of three-dimensional bodies not being required. The play value therefore exhausts itself for many users after a short time.

The task forming the basis of the invention consists in creating a puzzle cube of the initially named species, which on the use in the manner of a three-dimensional puzzle addresses the spatial capability of imagination of the user also in respect of the spatial orientation and structure of the individual components.

According to the invention, the problem is solved thereby, that the volume of the cube is subdivided into sixty-four equally large small cubes, that thirteen geometrically different components are provided, each of which consists of several small cubes, which are placed with their side surfaces flush one against the other and firmly connected one with the other, and that at least two small cubes are placed one against the other in each of three mutually perpendicular spatial directions in each of the components.

Through this structuring according to the invention it is attained that the solution of the puzzle, namely the assembly of the cube from the components one detached from the other, does not remain in the memory of the user even after the user has already succeeded once in assembling the cube. Rather, the user is confronted during each new attempt with the demanding task of comparing a gap, which is present during the build-up of the cube, with the remaining components present in random orientation, to check the individual components in respect of their structure and to associate it with the gap to be filled, in a given case, through thoughtful spatial re-orientation. The difficulty of this task arises in that case above all thereby, that on the one hand a quite high number of components is provided and that on the other hand the components each consist of small cubes placed one against the other in all three spatial directions. The recognisability of the shape of a randomly oriented component is thereby entailed by appreciable difficulties which even after long practice time do not let the assembly become a routine operation.

A particular advantage is furthermore to be seen in that the individual components of the cube also let themselves be assembled into other spatially geometric bodies differing from a cube so that the play value remains maintained for a long time and the spatial imagination of the user is always again provoked anew into thinking-up new assembled bodies.

In a preferred embodiment of the cube according to the invention, it is provided that twelve components consist of five small cubes, wherein two small cubes are respectively present in each of two of three mutually perpendicular spatial directions and three small cubes are present in the third spatial direction, and that one of the components consists of four small cubes, wherein two small cubes are placed one against the other in each of the three spatial directions. For an embodiment of that kind, it is particularly difficult to recognize the components, present at random and one loose from the other, according to their structure and to bring them into comparison into the spatially fitting orientation in accordance with the gap to be filled up.

It is provided in this embodiment that the surface of each of the components consisting of five small cubes consists of twenty-two small cube side surfaces and that the surface of the component consisting of four small cubes comprises eighteen small cube side surfaces.

It is particularly advantageous when those edges of the small cubes, which are held together in one component, are structured to be visible. This means that those edges of the small cubes of a component, which lie one against the other, have the same appearance as those edges of two adjoining components, which lie loosely one against the other. It is thus not possible in the assembled cube to distinguish the mutually shutting faces of the individual components from the abutting faces of the small cubes within a component.

Advantageously, the components consists of a material, the surfaces of which display a high co-efficient of friction one relative to the other. Advantageously, the components consist of a slip-resistant synthetic material. Through these measures, the assembly of the cube is facilitated purely mechanically, since already assembled components can not so easily slip one relative to the other.

A further preferred refinement provides that a marking of colouring matter shining in the dark is applied at each small cube side surface lying freely at the surface of each component. The attraction of the cube during playing is increased thereby. Preferably, these markings are applied in round depressions in the side surfaces of the small cubes so that a certain mechanical protection of the markings is given on the one hand and also a mechanical feelable marking is afforded through the depressions on the other hand.

Figure 1:
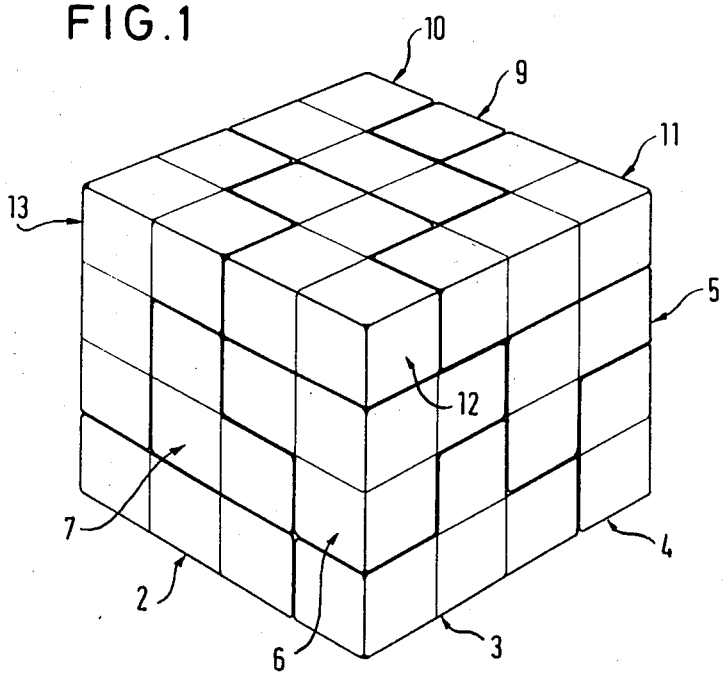
Figure 2:
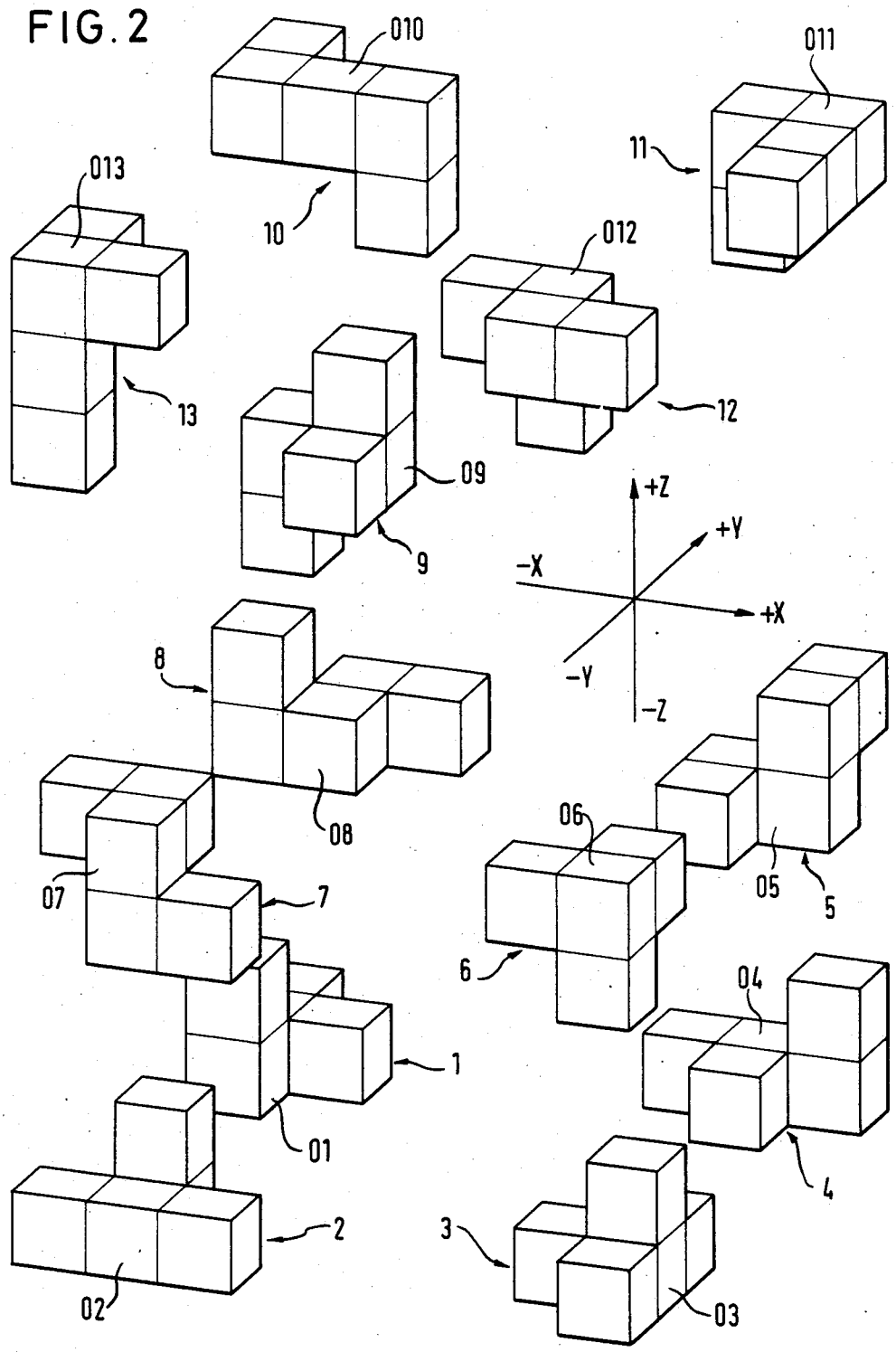
Figure 3:
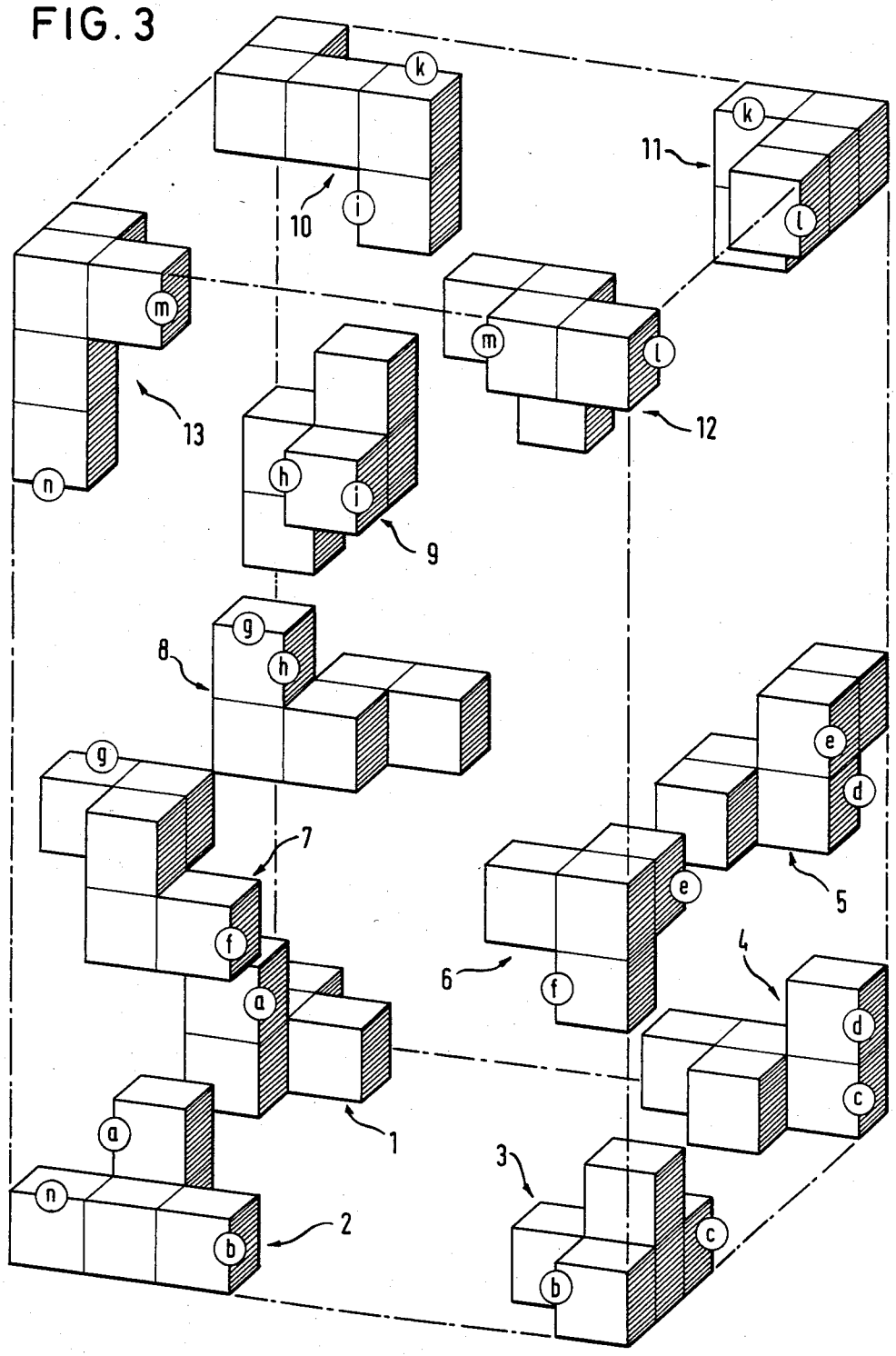

The invention is more closely explained in the following by way of example with reference to the drawing; there show:

FIG. 1 an assembled puzzle cube in perspective illustration,

FIG. 2 perspective views of the thirteen components of the puzzle cube,

FIG. 3 a perspective exploded illustration of the components in correct orientation according to the assembled cube and FIG. 4 a perspective view of a component to enlarged scale.

The puzzle cube is shown in perspective in the assembled state in FIG. 1. As is recognisable, it is composed of altogether sixty-four equally large small cubes. These small cubes are combined into altogether thirteen components, of which the components 2, 3, 4, 5, 6, 7, 9, 10, 11, 12 and 13 are visible in the illustration of the FIG. 1. The adjoining edges in the FIG. 1 in order to make the structure of the individual components recognisable. In a practical embodiment of the cube, these mutually abutting edges are however not distinguisable from the mutually abutting edges of the small cubes connected to adhere firmly together within a component.

The individual components 1 to 13 are illustrated in perspective in the FIG. 2. To facilitate the description, a co-ordinate system with the spatial directions X, Y and Z is drawn in FIG. 2, wherein the individual components 1 to 13 are each oriented in such a manner that the edges of the small cubes forming the components extend in or parallelly to these spatial directions. As is recognisable, the components 1 to 13 are differently shaped, no two like components thus existing.

In the following explanation of the spatial structure of the individual components, it is each time presupposed that the origin of the co-ordinate system is each time arranged in the centre of one of the small cubes, wherein the orientation of the edges of the small cubes parallel to the co-ordinate axes is maintained in correspondence with the orientation illustrated in the FIG. 2:

Component 1: Adjoining the small cube 01 lying in the co-ordinate origin upwardly in +Z direction is further small cube, whilst two further small cubes adjoin in +Y direction. Joined to the first small cube adjoining in +Y direction is beyond that a further small cube in +X direction.

Component 2: Adjoining the small cube 02 lying in the co-ordinate origin is a respective small cube in +X, +Y and −X direction. A further small cube is joined in +Z direction above the small cube placed on in +Y direction.

Component 3: Adjoining the small cube 03 lying in the co-ordinate origin is a further small cube each time in +Y, −X, −Y and +Z direction.

Component 4: Adjoining the small cube 04 lying in the co-ordinate origin is a small cube in +X, −X and −Y direction. Additionally, a further small cube is placed on in +Z direction above the small cube joined on in +X direction.

Component 5: Placed on the small cube 05 in the coordinate origin on the one hand in +Z direction is a small cube, at which a further small cube adjoins in +Y direction, whilst beyond that on the other hand placed on the small cube 05 in −X direction is a small cube, to which a further small cube is joined on in −Y direction.

Component 6: Adjoining the small cube 06 lying in the co-ordinate origin is a respective further small cube in +Y, −X and −Z direction.

Component 7: Adjoining on the one hand downwardly in −Z direction at the small cube 07 in the co-ordinate origin is a small cube, to which in its turn a small cube is joined on in +X direction, whilst on the other hand placed at the small cube 07 in +Y direction is a small cube, at which a further small cube is joined on in −X direction.

Component 8: Adjoining on the one hand in +Y direction at the small cube 08 lying in the co-ordinate origin is a further small cube, at which in its turn a small cube is placed on in +Y direction, and on the other hand placed on at the small cube 08 in −X direction is a small cube, on which the last small cube of the component 8 sits in +Z direction.

Component 9: Starting out from the small cube 09 in the co-ordinate origin is a respective small cube in −Y, +Z and −X direction, wherein a further small cube is joined on at the last in −Z direction.

Component 10: Adjoining the small cube 010 in the co-ordinate origin is a respective small cube in +X as well as also in −X direction, wherein a further small cube is placed on in −Z direction at that one in +X direction, whilst a further small cube is joined on in +Y direction at the small cube in −X direction.

Component 11: Adjoining the small cube 011 in the co-ordinate origin are two small cubes one behind the other in −Y direction, whilst on the other hand adjoining the small cube 011 also in −X direction is a further small cube, at which the last small cube adjoins downwardly in −Z direction.

Component 12: Adjoining the small cube 012 in the co-ordinate origin is a respective small cube in −Z, −X and −Y direction, wherein joined onto the last named small cube in −Y direction is a further small cube in +X direction.

Component 13: A respective small cube is placed in +X as well as also in +Y direction against the small cube 013 in the co-ordinate origin, whilst two successive small cubes are joined at the small cube 013 in −Z direction.

It is thus evident from the preceding description in conjunction with the illustration of the FIG. 2 that the twelve components 1 to 5 and 7 to 13 each consist of five small cubes, wherein two small cubes are arranged in two of three mutually perpendicular spatial directions and three small cubes are arranged in the remaining third spatial direction. The remaining component 6 consists of only four small cubes, wherein two small cubes are placed one against the other in each of three spatial directions. The small cubes are, is illustrated, each time joined in such a manner to the neighbouring small cube that the side surfaces sit in alignment one on the other and the adjoining edges of the neighbouring small cubes meet together.

It is furthermore evident that the surface of each of the components 1 to 5 and 7 to 13 consisting of five small cubes each time consists of twenty-two small cube side surfaces, whilst the surface of the component 6 consisting of four small cubes comprises only eighteen small cube side surfaces. The small cubes of each of the components 1 to 13 are connected in firmly adhering manner one with the other, for example in that the small cubes of each component are shaped integrally one with the other or the individual small cubes are after the individual manufacture connected adhesively one with the other, for example through gluing or welding together. The material of the individual small cubes or of the components is a slip-resistant synthetic material or another material, the surface of which posseses a high coefficient of friction. It is attained through this high co-efficient of friction that the components during the assembly are not easily displaceable one relative to the other so that putting together is facilitated.

In the FIG. 4, the component 8 is shown in detail in perspective, enlarged illustration. The component 8 consists of the individual small cubes 08, 81, 82, 83 and 84, which are assembled in the manner stated in the preceding. As shown, all free edges 15 of the individual small cubes are rounded off somewhat in this embodiment. The edges 16 mutually adjacent within the component 8 form a channel or groove which is about V-shaped in cross-section and offers the same appearance as abutting free edges 15 of neighbouring components in the partially or completely assembled cube according to FIG. 1. It is attained in this manner that the outlines of the individual components 1 to 13 are not visible in the assembled cube. The user is thus not in a position of noting the orientation and arrangement of the individual components starting out from a cube present in the assembled state.

Alternatively hereto, the free edges 15 of the individual small cubes can of course also be left sharp-edged. In this case, the adjoining edges 16 of the small cubes held together in a component can be indicated by only a very narrow incision in order that a distinguishing of the edges 16 and the free edges 15 in the assembled cube is not possible.

It is furthermore provided in the embodiment shown in the FIG. 4 that a small round depression 14, in each of which a respective marking 20 of colouring matter shining in the dark is applied, is shaped centrally in the area of each of the side surfaces of the individual small cubes of the component 8. It is attained through this arrangement of the marking 20 in the depression that the colouring matter is not mechanically stressed in use.

In the FIG. 3, the thirteen individual components 1 to 13 of the cube are drawn apart in perspective along the three spatial axes X, Y and Z into a parallelepiped indicated in chain-dotted lines. The spatial orientation of the individual components in that case corresponds to the arrangement in the assembled cube according to FIG. 1. Furthermore, as an aid to the successive assembly of the individual components, certain edges of the small cubes of the individual components are each time designated in FIG. 3 by small letters inserted in circles, wherein that edge of the neighbouring building block, which is provided with the like letter, is to be placed one against the other in alignment during the assembly. One thus starts for example with the block 1 and sets its edge a against the edge a of the block 2. Thereafter, the edge b of the block 3 is joined to the edge b of the block 2 and so forth, wherein the edge pairings c—c, d—d to n—n are produced each time and finally for example the block 13 is placed by its edge m against the edge m of the block 12 and by its edge n to the corresponding edge n of the block 2 so that the cube is completed according to the illustration of the FIG. 1.

I claim:

1. Puzzle cube consisting of a plurality of components which in spatially interengaging manner fill out the volume of the cube and are one detachable from the other, characterized thereby, that the volume of the cube is subdivided into sixty-four equally large small cubes, that thirteen geometrically different components are provided, each of which consists of several small cubes, which are placed with their side surfaces flush one against the other and firmly connected one with the other, and that at least two small cubes are placed one against the other in each of three mutually perpendicular spatial directions in each of the components; and further characterized thereby, that twelve of the components consist of five small cubes, wherein two small cubes are respectively present in each of two spatial directions of the three mutually perpendicular spatial directions and three small cubes are present in the third spatial direction, and that one of the components consists of four small cubes, wherein two small cubes are placed one against the other in each of the three spatial directions.

2. Cube according to claim 1, characterised thereby, that the surface of each of the components consisting of five small cubes consists of twenty-two side surfaces of small cubes and that the surface of the component consisting of four small cubes comprises eighteen side surfaces of small cubes.

3. Cube according to any one of claims 1 or 2, characterised thereby, that those edges of the small cubes held together in one component, which lie one against the other at the external surface of a component, are structured to be visible.

4. Cube according to claim 3, characterised thereby, that the components consist of a material, the surfaces of which display a high co-efficient of friction one against the other.

5. Cube according to claim 4, characterised thereby, that the components consist of slip-resistant synthetic material.

6. Cube according to claim 3, characterised thereby, that a marking of colouring matter shining in the dark is applied at each of those side surfaces of small cubes, which lie free at the surface of each component

7. Cube according to claim 6, characterised thereby, that the markings are applied in round depressions.

* * * * *

UNITED STATES PATENT AND TRADEMARK OFFICE

CERTIFICATE OF CORRECTION

PATENT NO. : 4,662,638

DATED : May 5, 1987

INVENTOR(S) : VACHEK

It is certified that error appears in the above-identified patent and that said Letters Patent is hereby corrected as shown below:

Column 3, line 12, after "edges" insert --of the visible components are indicated by thickened lines--.

Signed and Sealed this

Twenty-fifth Day of August, 1987

*Attest:*

DONALD J. QUIGG

*Attesting Officer*

*Commissioner of Patents and Trademarks*